US009181954B2

(12) United States Patent
Ahonen et al.

(10) Patent No.: US 9,181,954 B2
(45) Date of Patent: Nov. 10, 2015

(54) METHOD IN CONNECTION WITH A PUMP DRIVEN WITH A FREQUENCY CONVERTER AND FREQUENCY CONVERTER

(75) Inventors: Tero Ahonen, Lappeenranta (FI); Jussi Tamminen, Lappeenranta (FI); Jero Ahola, Lappeenranta (FI)

(73) Assignee: ABB TECHNOLOGY OY, Helsinki (FI)

( * ) Notice: Subject to any disclaimer, the term of this patent is extended or adjusted under 35 U.S.C. 154(b) by 1001 days.

(21) Appl. No.: 13/024,705

(22) Filed: Feb. 10, 2011

(65) Prior Publication Data

US 2011/0200454 A1 Aug. 18, 2011

(30) Foreign Application Priority Data

Feb. 10, 2010 (EP) ..... 10153168

(51) Int. Cl.
*F04D 15/00* (2006.01)
*F04D 27/00* (2006.01)

(52) U.S. Cl.
CPC ..... *F04D 15/0088* (2013.01); *F04D 27/001* (2013.01)

(58) Field of Classification Search
CPC ..... F04D 27/001; F04D 15/0088
USPC ..... 417/53, 572; 73/168; 700/282
See application file for complete search history.

(56) References Cited

FOREIGN PATENT DOCUMENTS

EP 1 072 795 A1 1/2001
JP 3-168386 A 7/1991

OTHER PUBLICATIONS

Ahonen et al., Estimation of pump operational state with model-based methods, Journal of Energy Conversion and Management 51 (2010) 1319-1325, published (available online) Feb. 4, 2010.*
European Search Report issued on Aug. 9, 2010.

* cited by examiner

*Primary Examiner* — Charles Freay
*Assistant Examiner* — Patrick Hamo
(74) *Attorney, Agent, or Firm* — Buchanan Ingersoll & Rooney PC

(57) ABSTRACT

An exemplary frequency converter and method are directed to estimating an operation point of a pump when the QH characteristic curve of the pump is known. The frequency converter controls the pump, and a process curve is estimated when a first operation point of the pump is in the nominal range. The process curve defines a head as a function of volumetric flow. A rotational speed of the pump is determined and a QH characteristic curve of the pump is converted to a current rotational speed of the pump based on affinity laws. A second operation point of the pump is estimated by determining an intersection point of the converted QH characteristic curve and the estimated process curve.

12 Claims, 11 Drawing Sheets

METHOD IN CONNECTION WITH A PUMP DRIVEN WITH A FREQUENCY CONVERTER AND FREQUENCY CONVERTER

RELATED APPLICATIONS

This application claims priority under 35 U.S.C. §119 to European Patent Application No. 10153168.9 filed in Europe on Feb. 10, 2010, the entire content of which is hereby incorporated by reference in its entirety.

FIELD

The present disclosure relates to a pump, such as estimating the output of a pump which is driven with a frequency converter and without additional sensors.

BACKGROUND INFORMATION

The operation point of a centrifugal pump can be estimated using a torque estimate (Test) and a rotational speed estimate (nest) from the frequency converter and the QH and QP characteristic curves provided by the pump manufacturer together with affinity laws. This method is referred to as QP calculation. The estimate of the operation point (volumetric flow Qv and head h) obtained with the calculation is most accurate at the nominal (i.e., best efficiency) operation point of the pump, and its accuracy becomes poorer when moving away from the nominal operation point. This limits the usability of the QP calculation in estimating the operation point of the pump. An alternative estimation method or improvement of the existing QP calculation algorithm is, therefore, required for the accurate estimation of the operation point of a centrifugal point, when the pump is operating outside/away from the nominal point.

One reason for the inaccuracy of QP calculation is that the slope of the QP curve gets lower when the efficiency of the pump decreases, which takes place when moving away from the nominal operating point. This causes errors in the estimation of the volumetric flow and head produced by the pump. Another reason for the inaccuracy is the fact that a notable change of the rotational speed can affect the efficiency of the pump. In addition, the amount of mechanical losses in the pump at different speeds may affect the accuracy of the affinity laws. These factors are not typically taken account in the affinity laws.

When the pump operates in a normal manner, the operation point is always situated at the intersection of QH curves of the pump and the process. This is illustrated in FIG. 1, in which an example of a QH curve of a process is drawn against the QH characteristic curve of a pump. The QH curve of the pump is presented in FIG. 1 as a set of curves drawn at different rotational speeds of the pump. The example of FIG. 1 also includes the efficiency of the pump. Thus, it can be read from the curves of FIG. 1 that when the pump is operated at the speed of 1400 rpm, the pump produces a head of 17 m and the output of the pump is 30 l/s. Further it can be seen that the pump is operated at its most efficient operating point, the co-efficient of efficiency being about 73%.

SUMMARY

An exemplary embodiment is directed to a method of estimating an operation point of a pump driven with a frequency converter when a QH characteristic curve of the pump is known. The method includes controlling the pump with the frequency converter, by estimating a process curve when a first operation point of the pump is in a nominal range, the process curve defining a head required by the process as a function of volumetric flow. The frequency converter further controls the pump by determining a rotational speed of the pump, converting the QH characteristic curve of the pump to a current rotational speed of the pump, and estimating a second operation point of the pump by determining the intersection point of the converted QH characteristic curve and the estimated process curve.

Another exemplary embodiment is directed to a frequency converter that estimates an operation point of a pump when a QH characteristic curve of the pump is known and the pump is adapted to be driven with the frequency converter. The frequency converter includes means for estimating a process curve when a first operation point of the pump is in a nominal range, the process curve defining a head as a function of volumetric flow means for determining a rotational speed of the pump, and means for converting, based on affinity laws, the QH characteristic curve of the pump to a current rotational speed of the pump. The frequency converter also includes means for estimating a second operation point of the pump by determining an intersection point of the converted QH characteristic curve and the estimated process curve.

BRIEF DESCRIPTION OF THE DRAWINGS

In the following the disclosure will be described in greater detail by means of exemplary embodiments with reference to the accompanying drawings, in which.

DETAILED DESCRIPTION

An object of an exemplary embodiment of the present disclosure is to provide a method and an apparatus for implementing the method so as to solve the above problem in the estimation of the operating point of the pump.

The disclosed exemplary embodiments are directed to estimating the process curve using QP calculation when the pump is operated in or close to the nominal operation area. The obtained process curve is then used for estimating the output of the pump by calculating the intersection point of the process curve and the QH curve of the pump, which is converted with affinity laws to the current rotational speed of the pump. This intersection calculation can be carried out if the pump is operated outside of its nominal operation area.

In an exemplary embodiment, the validity of the process curve is monitored using the intersection point calculation and QP calculation. The results of these two calculations are compared with each other to determine whether the process has changed.

The advantage of the exemplary method is that the estimation of the operation point is more accurate than with the other known methods that do not apply direct sensing of the head or the volumetric flow rate.

The disclosed exemplary embodiments also relate to a frequency converter which carries out the disclosed method. Such an apparatus can be used in estimating the operation point of the pump.

An exemplary method of the disclosure can be divided into separate entities. First, the process curve can be estimated. This estimation is carried out using QP calculation, as will be described later. After the process curve has been estimated, the operation point of the pump can be calculated using information on the rotational speed of the pump, the known pump QH characteristic curve, and the estimated process curve. According to an exemplary embodiment, the validity of the estimated process curve is monitored while the pump is being used.

Figure 3:
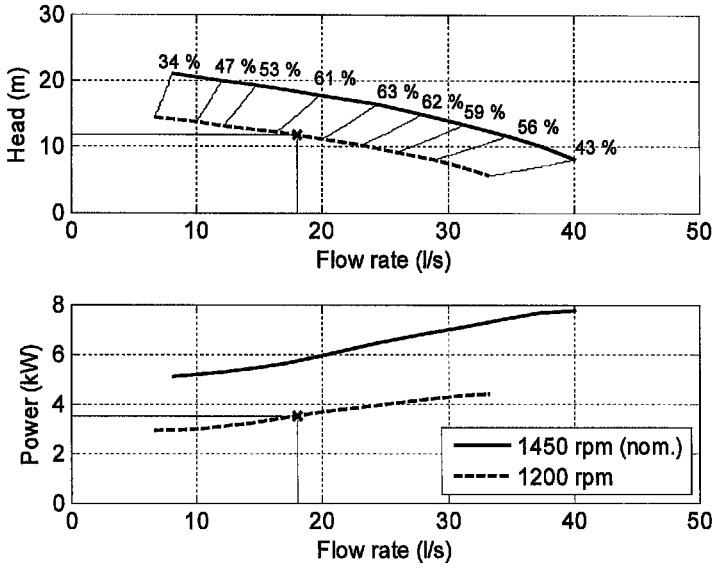
FIG. 3 shows examples of QH and QP curves of a pump in accordance with an exemplary embodiment.

In the above referred QP calculation, the operation point of the pump can be continuously estimated using a torque estimate and a rotational speed estimate, which are produced by the frequency converter that controls the pump. Further, the characteristic curves of the pump are required for the calculation. FIG. 3 shows an example of a QH characteristic curve and a QP characteristic curve of a pump in accordance with an exemplary embodiment. The mechanical power $P_{mec}$ produced by the motor and consumed by the pump can be calculated using the estimates of the rotational speed of the motor $n_{est}$ and the torque $T_{est}$ with equation $$P_{mec} = \omega_{est} T_{est} = 2\pi \frac{n_{est}}{60} T_{est}, \tag{1}$$

in which $\omega_{est}$ is the estimate of the angular speed of the motor.

The relationship between the mechanical power consumed by the pump and volumetric flow produced by the pump is shown in the QP curve, which is the lower plot in the example of FIG. 3. The manufacturer of the pump provides the curves for one rotational speed only. When the pump is used at a speed different from the nominal speed, the QP curve has to be converted based on the affinity laws to the current rotational speed. Power and volumetric flow can be converted with the following affinity laws $$P = \left(\frac{n}{n_0}\right)^3 P_0 \tag{2}$$

-continued $$Q = \frac{n}{n_0} Q_0 \tag{3}$$

in which n is the used rotational speed, $n_0$ is the rotational speed for which the curves are defined, $P_0$ is the mechanical power at the original rotation speed, P is the power at the new rotational speed, $Q_0$ is the volumetric flow at the original rotational speed, and Q is the volumetric flow at the new rotational speed. In FIG. 3, the original curves provided by the pump manufacturer are drawn in solid lines and the ones converted using the affinity laws with dashed lines.

The head produced by the pump can be determined by the volumetric flow, which is determined from the mechanical power fed to the pump. The head is determined from the curve representing the head as a function of volumetric flow (QH curve), which is the upper plot in FIG. 3. Like the QP curve, the QH curve must also be converted to the used rotational speed. The volumetric flow is converted with equation (3) and the head produced by the pump with equation $$H = \left(\frac{n}{n_0}\right)^2 H_0, \tag{4}$$

in which H is the head produced by the new rotational speed and $H_0$ is the original value of the head at the nominal rotational speed $n_0$.

The coefficient of efficiency of the pump can be estimated from the hydraulic power produced by the pump and the mechanical power required by the pump. The hydraulic power $P_h$ is defined as $$P_h = \rho g Q_v h \tag{5}$$

in which ρ is the density of the pumped fluid and g is the gravitational constant. The coefficient of efficiency is defined as $$\eta = \frac{P_h}{P_{mec}}. \tag{6}$$

Unlike the other quantities, the coefficient of efficiency does not have affinity laws. In theory, according to equations (2)-(6) the rotational speed of the pump should not have any influence on the efficiency of the pump. In practice, the decrease of the rotational speed decreases the Reynolds number of the flow and, therefore, also the hydraulic efficiency of the pump. Accordingly, the increase of the rotational speed increases the efficiency of the pump unless the pump starts to cavitate. Due to the above, the characteristic curves provided by the pump manufacturer, the affinity rules are only valid in a limited rotational speed range. Generally it can be considered that if the rotational speed of the pump differs less than 20% from the nominal speed, the co-efficient of efficiency does not change merely due to a change of the rotational speed in a manner that would lead to inaccurate QP calculation results.

The QP calculation can be considered to be most exact in the range close to the nominal operation point of the pump. In this range, the changes in the coefficient of efficiency are considerably small and QP curve has its steepest portion. In connection with a radial centrifugal pump, the preferred range of operation is about 80 to 120% of the nominal volumetric flow and of the nominal rotational speed. If needed, the preferred operation range can be defined more closely on the basis of the behavior of the steep portion of the QP curve and from the behavior of the coefficient of efficiency of the pump.

The estimation of a process curve includes a continuous or nearly continuous calculation of the operation point of the pump using the above QP calculation. Further, in the estimation of the process curve the measurement points are stored when the pump is operating near its nominal point. The measurement point is stored after the rotational speed of the pump has changed while still in the preferred range of operation. Further, the curve is fitted to the measured points. The estimation of a process curve is presented in the flow diagram of FIG. 17.

Figure 17:
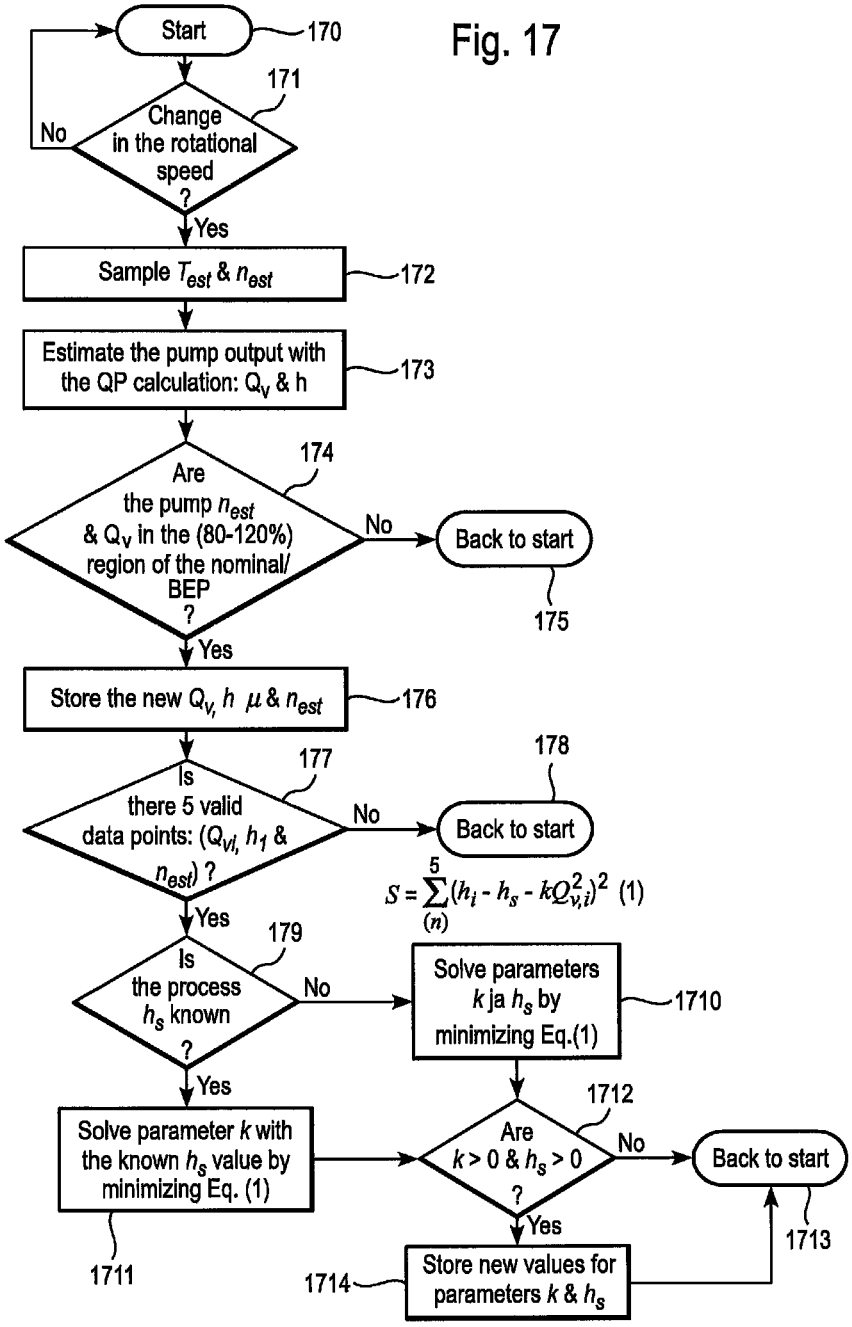
FIGS. 17, 18 and 19 show flowcharts relating to the operation of the method in accordance with an exemplary embodiment.

In FIG. 17 the process starts by checking if the rotational speed has changed (171). If the speed has not changed, the process returns to the start (170). If the speed has changed, $T_{est}$ and $n_{est}$ are sampled (172) and the output of the pump is estimated using the QP calculation (173).

After the QP calculation, it is checked if the values obtained with the QP calculation show that the pump is in its nominal operation range (174). If not, then the process returns to the start (175). If the values are in the nominal operation range, the values are stored (176).

After the values are stored, it is checked if there are five valid data points (177). If there are less than five data points stored, then the process returns to the start (178). If five data points are stored, it is checked (179) if $h_s$ of the process is known. If $h_s$ is not known, parameters k and $h_s$ are solved (1710) by minimizing equation (1) shown in FIG. 17. If, on the other hand, $h_s$ is known, only parameter k is obtained by minimizing equation (1) (1711).

After step 1710 or 1711 it is checked if k and $h_s$ are positive (1712). If the values are not positive, the process returns to the start 1713. Once the values are positive, they are stored (1714). In the example of the flow chart of FIG. 17, five data points have been selected to be sufficient for solving the parameters.

The characteristic curve of the process, i.e. the process curve, can be of the format $$h_{process}=h_s+kQ_v^2, \tag{7}$$

in which $h_s$ is the static head and the term k represents the dynamic flow resistance. Both values depicting the shape of the process curve are normally positive $h_s$, $k\geq 0$.

Figure 2:
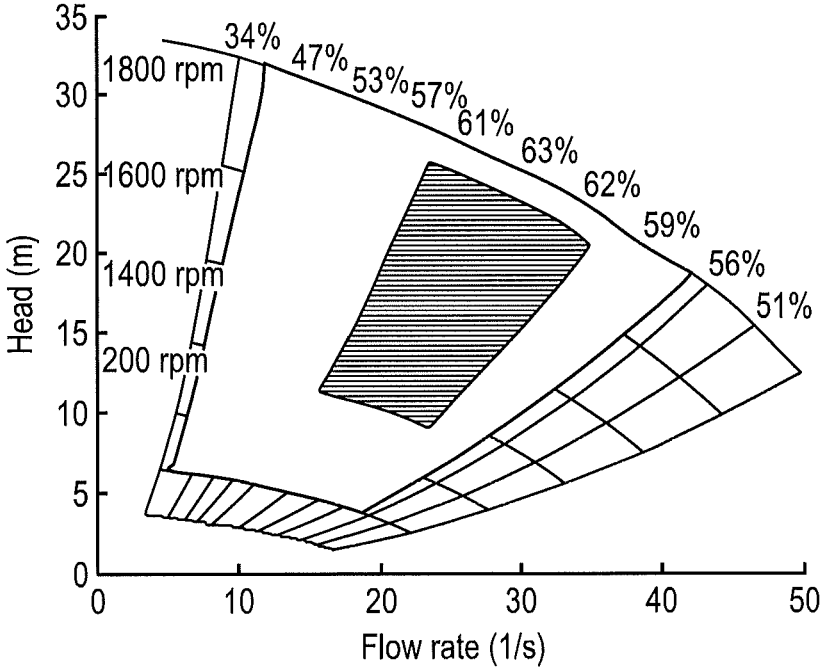
FIG. 2 shows an example of a QH curve of a pump in accordance with an exemplary embodiment.

When the rotational speed of the pump changes and when the operation point of the pump is in the nominal range, the operation point of the pump is determined using a QP calculation. When the rotational speed changes, the operation point $\hat{Q}_{v,i}, \hat{h}_i$ estimated with the QP calculation is stored together with the present rotational speed $n_{est,i}$, if the operation point is in the range or area near the nominal operation point. The nominal operation area is shown in FIG. 2 as a hatched area.

Figure 1:
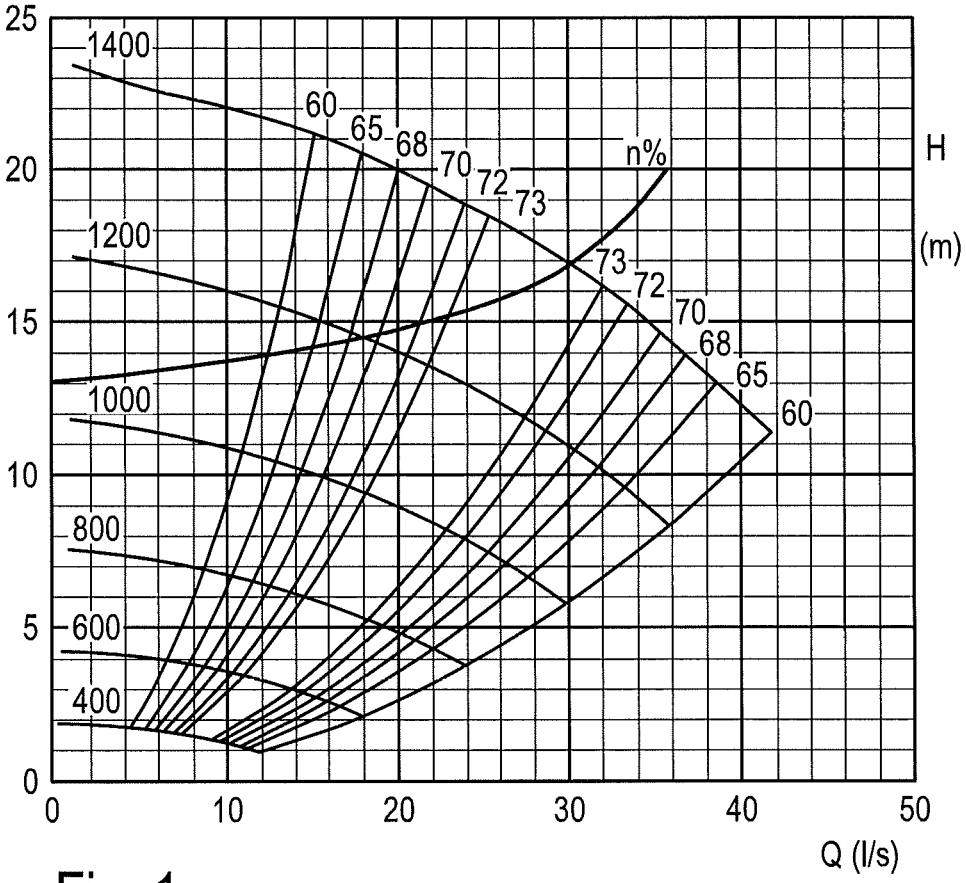
FIG. 1 is an example of QH curves of a conventional pump and process.

At least two operation points are required for estimating the process curve. In practice, however, the number of operation points should be higher in order to obtain a reliable estimate of the process curve. For example, five operation points are found to be a suitable number for obtaining reliable results. Further, the operation points should preferably be gathered in a large rotational speed range such that the shape of the process curve would be as correct as possible. For example, as illustrated in FIG. 1, the set of stored data should be gathered from the minimum speed range of 50 to 100 rpm to find out the shape of the curve. In addition to the above, the operation points should be gathered in such a time period that the process itself has not changed and, thus, the process curve is constant.

If, at the beginning, the available measurement points are from a very low rotational speed range, for example under 10 rpm, and, for example, the static head of the process is not known, the process curve can be estimated to be mostly constructed from the static head, which is typical in the water distribution applications. Then, for example, in the nominal operation point $$(h=h_{process})$$

$$h_s=0.75\cdot h_{process}, \tag{8}$$

$$kQ_v^2=0.25\cdot h_{process} \tag{9}$$

Further, the share of the static head could be approximated on the basis of the pumping application for this step. For the liquid transfer application between reservoirs, the share of the static head could be 50% of the total head (i.e., $h_{process}$). However, in most of the pumping applications the change rate of the static head is very slow and the range of possible static head values can be estimated, or the static head can even be presumed to remain relatively constant. In addition, the dynamic head is usually small when compared to the static head in well-engineered applications. This leads to a process curve which is flat as a function of volumetric flow. Thus, the accurate estimation of the static head may be considered more important than the estimation of the dynamic head.

Since the process curves are case-dependent, the probable variation of $h_s$ could alternatively be given to the procedure, if more accuracy is required in the case of a small rotational speed range. When more measurement points are achieved, maybe also from a larger range, the shape of the process curve can be corrected by re-calculating new estimates for the static head $h_s$ and the dynamic flow resistance k of the process without the assumptions of equations (8) and (9).

When the data has been gathered, a method of least squares can be used for forming the process curve. In the method of least squares, equation $$S=\sum_{i=1}^{n}\left(\hat{h}_i-h_s-k\hat{Q}_{v,i}^2\right)^2 \tag{10}$$

is minimized. The equation is at its smallest when $h_s$ and k form a process curve which corresponds to the measurement points as closely as possible. The minimum of S and the parameters of the process curves can be solved numerically or iteratively using, for example, a simplex-method.

Figure 4:
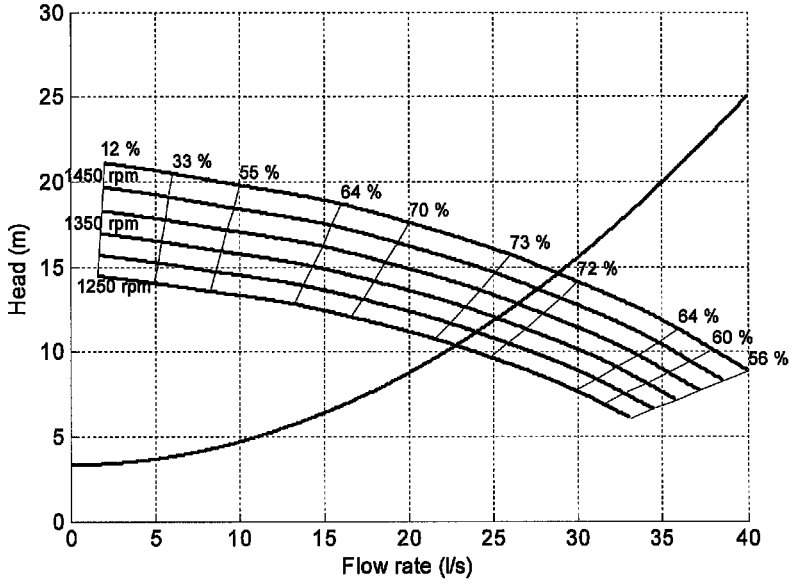
FIG. 4 shows QH curves in connection with intersection point estimation in accordance with an exemplary embodiment.

Once the process curve has been determined, the operation point of the pump can be determined by solving the intersection point between the process curve (equation (7)) and the QH curve that has been converted to the current rotational speed (equations (3) and (4)). The intersection point can be solved by using numerical interpolation according to FIG. 4. FIG. 4 shows the estimated process curve and a set of QH curves in accordance with an exemplary embodiment. Each QH curve in the set of curves represents a different rotational speed. When compared to QP calculation, the difference of the intersection calculation is that only the rotational speed estimate nest is used. The rotational speed estimate is obtained directly from the frequency converter driving the pump. Since the intersection calculation only uses the rotational speed estimate, the calculation is more accurate than QP calculation when the pump is not operated in its nominal operation range.

Figure 18:
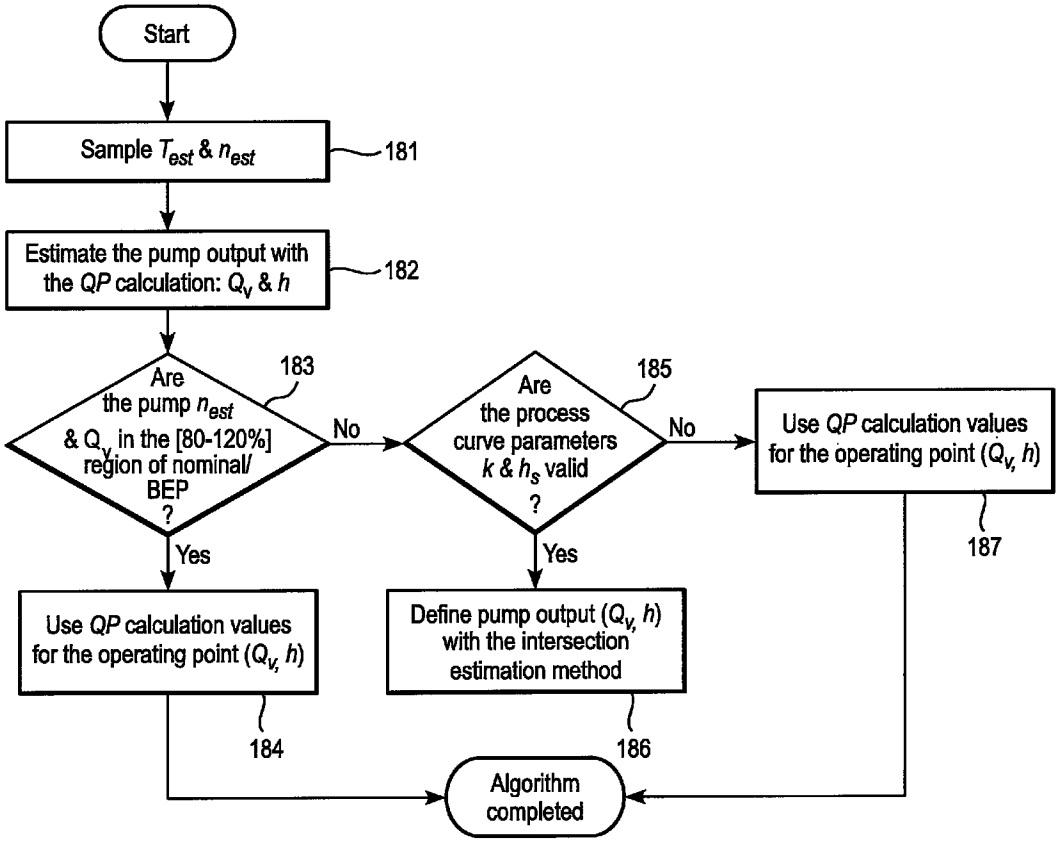

FIG. 18 is a flowchart illustrating a procedure for estimating the operation point of the pump in accordance with an exemplary embodiment. In FIG. 18, the procedure is started by sampling (181) the torque and the rotational speed estimates. After the sampling, the output Qv and the head h of the pump are estimated (182) using a QP calculation. In the next step, it is checked (183) if the estimated rotational speed and the volumetric flow (i.e. the output) of the pump are in the nominal operating region, which is preferably between 80% and 120% of the nominal values. If the values are in the nominal region, then the values obtained in (182) are used as estimates for the operation point (184).

If the rotational speed and the volumetric flow are outside the nominal region, it is checked (185) if parameters for the process curve are valid. If the parameters are valid, the intersection point calculation is used (186) for estimating the output of the pump. If the parameters for the process curve are not valid, the values of the QP calculation in (182) are used as the output of the pump (187).

According to an exemplary embodiment, the validity of the process curve is monitored. When the operation point is estimated using both the QP calculation and the calculation of the intersection point, the difference between the results obtained with these two can be used to estimate if the calculated process curve is correct. If the process remains unchanged, the operational points obtained with the QP calculation and the intersection point calculation should remain the same. The comparison between the results can be carried out, for example, by subtracting the results obtained with one from the other. That is, by subtracting the volumetric flow estimates obtained with differing methods from one another and similarly subtracting the estimates of the head produced by the pump obtained with differing methods from one another. These error terms ΔQ, Δh (equations (11), (12)) should stay the same at the same rotational speed points (for example 1300, 1350, . . . , 1500 rpm) if the process is unchanged $$\Delta Q = Q_{v,QP} - Q_{v,intersection} \tag{11}$$

$$\Delta h = h_{QP} - h_{intersection} \tag{12}$$

Once the process changes, the operation point of the pump moves, affecting the power consumption of the pump. This affects the results of the QP calculation and the magnitude of the error terms of equations (11) and (12). When it is noticed that the error terms have been changed at the constant speed points, it can be assumed that the process has changed and new values should be calculated for the parameters of the process curve. This means that the process curve should be estimated again using the above described procedure. The estimation of validity is presented in the flowchart of FIG. 19.

Figure 19:
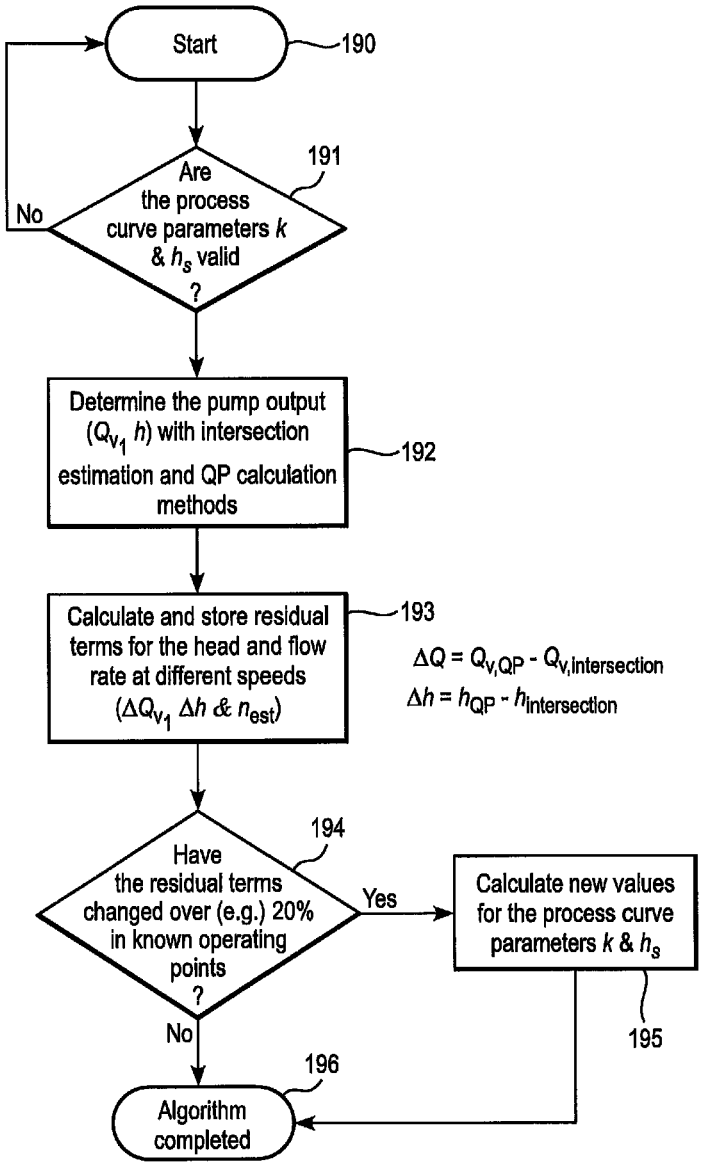

At the beginning of the flowchart of FIG. 19 the validity of the process curve parameters is checked (191). If they are not valid, the process returns to start (190). If the parameters are valid, the pump output is determined using the intersection estimation and QP calculation (192). A difference value between calculated head and flow rate values are calculated using Equations (11) and (12) and stored (193), after which it is checked if the difference between the values has changed (194). In the exemplary process shown in the flowchart of FIG. 19, a change of 20% in the values is regarded as the limit for determining that new values for the process curve will be calculated (195). If the change is smaller than 20%, the values are not re-calculated and the algorithm is completed (196).

In addition to the change of the process, the error terms may also change due to normal wear of the pump, a malfunction of the pump, or some other factor disturbing the normal operation of the pump. Usually all the above factors can be noticed with condition monitoring measurements. Further, these factors disturb the operation of the pump quite seldom, and it is more likely that the changes in the error terms are due to changes in the process.

Figure 5:
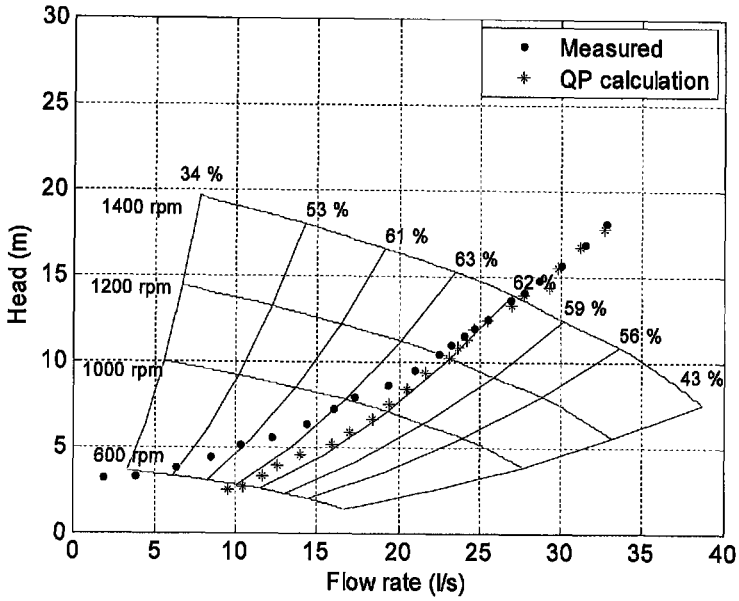
FIGS. 5 and 6 show test results of an estimation algorithm in accordance with an exemplary embodiment.

In the following, exemplary embodiments of the disclosure are described in connection with actual measurements. FIG. 5 discloses results from test equipment, obtained using both QP calculation (marked with '*') and with direct measurements (marked with '•') by means of pressure sensors and a volumetric flow sensor. During the measurement series, the pump was operated at a speed ranging from 570 rpm to 1620 rpm and the pressure side valves, which have an effect on the dynamic head of the pump, were set such that the operation of the pump was in its preferred operational range when the pump had its nominal speed. The static head $h_s$ of the process was 3.4 m during the measurements.

Figure 6:
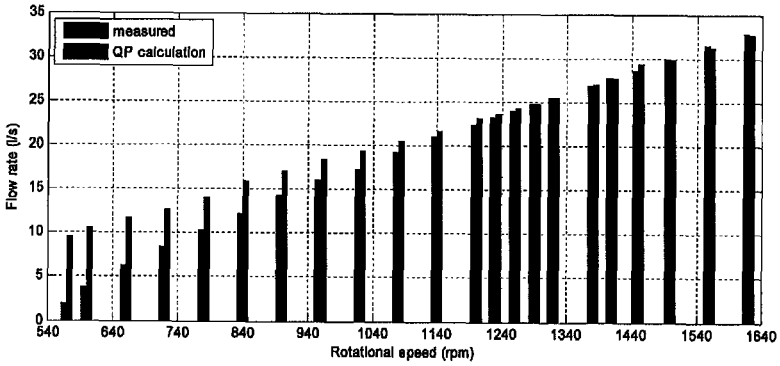

As shown in FIG. 5, the results obtained with the QP calculation are not correct when the rotational speed of the pump is under 1000 rpm. It can thus be seen that the QP calculation as such is not usable in determining the lowest advisable rotational speed and the static head. On the other hand, at rotational speeds above 1200 rpm the error between the measured and calculated values is smaller than 3%. Thus, in the preferred operation range the QP calculation depicts the operation of the pump quite accurately. FIG. 6 shows a diagram representing the measured and calculated values of the volumetric flow in accordance with an exemplary embodiment. It can be seen from FIG. 6 that when the rotational speed is lower than 1000 rpm, the values obtained with the QP calculation produce too high results. FIG. 6 shows two bars at each rotational speed, the left bars of the diagram are the calculated values and the bars on the right are the results obtained with a direct measurement.

Figure 7:
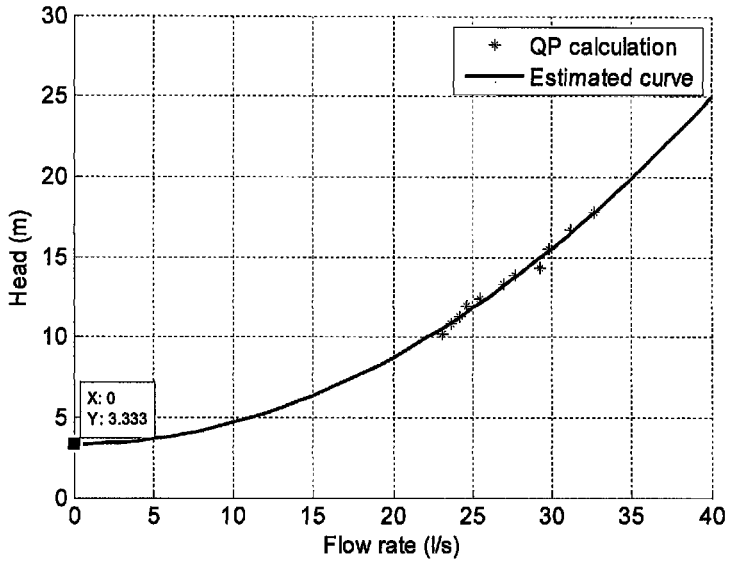
FIG. 7 shows an example of an estimated process curve in accordance with an exemplary embodiment.

FIG. 7 shows a process curve in accordance with an exemplary embodiment. This curve is obtained from the results of the QP calculation from the speed range of 1160 to 1740 rpm, which corresponds to ±20% of the nominal speed (1450 rpm) of the pump. FIG. 7 shows the process curve calculated with the estimation algorithm and the calculated points that were used in the estimation of the process curve. The estimated process curve corresponds to the measured curve of FIG. 5 for both its shape and its static head.

Figure 8:
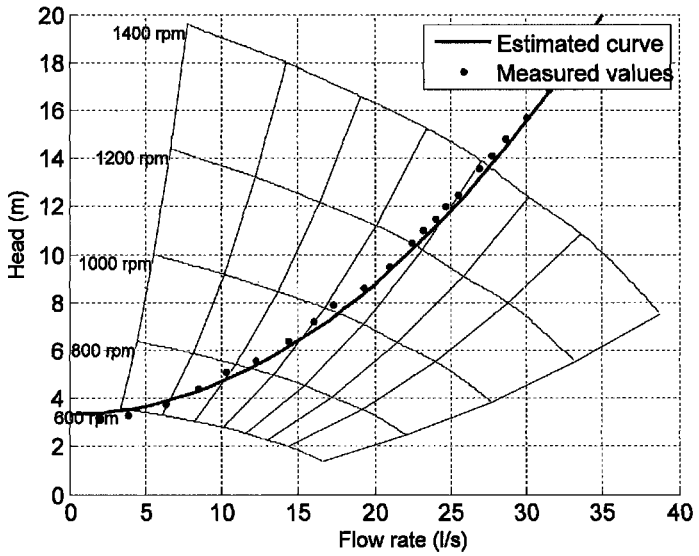
FIG. 8 shows an example of an estimated process curve and measured operation points in accordance with an exemplary embodiment.

FIG. 8 illustrates an estimated process curve and measured operation points in accordance with an exemplary embodiment. When the process curve is estimated, it can be used for calculating an estimate of the operation point of the pump. As shown in FIG. 8, the QH curve of the pump can be drawn to the current rotational speed of the pump by using affinity laws based on the rotational speed estimate $n_{est}$ provided by the frequency converter. The operation point of the pump can then be solved by determining the intersection point between the QH curve and the process curve. The separate points shown in FIG. 8 are actual measured values and the process curve is the estimated curve.

Figure 9:
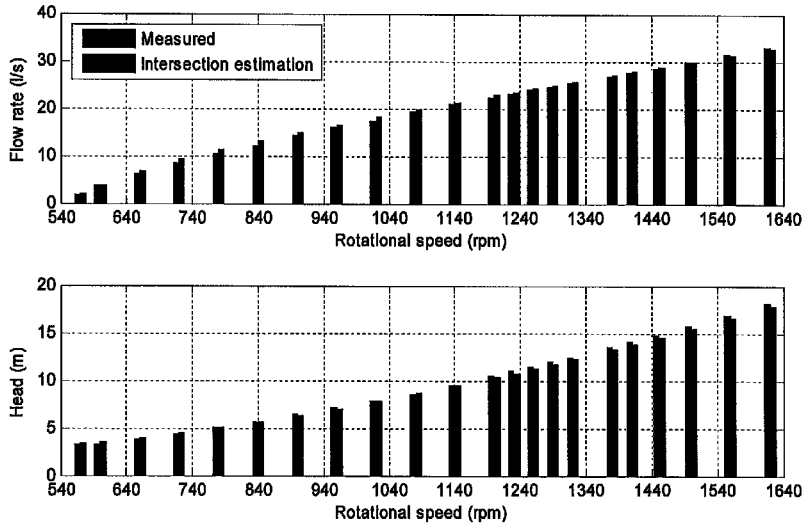
FIG. 9 shows comparative results of the estimation in accordance with an exemplary embodiment.

FIG. 9 is a graph illustrating comparative results of the estimation in accordance with an exemplary embodiment. In order to analyze the results achieved with the intersection point calculation, the estimated operation points in the speed range of 570 to 1620 rpm were solved. FIG. 9 shows results obtained with direct measurements and with the intersection point calculation. The upper bar diagram shows the volumetric flow and the lower bar diagram shows the head as a function of rotational speed. In the bar diagrams the bars on the left at each rotational speed are the measured results and the bars on the right are the estimated values. It can be seen that the intersection point calculation gives satisfactory results even at speeds lower than 1000 rpm. The results further show that the method gives sufficiently accurate estimates in a sufficiently wide operation range.

Figure 10:
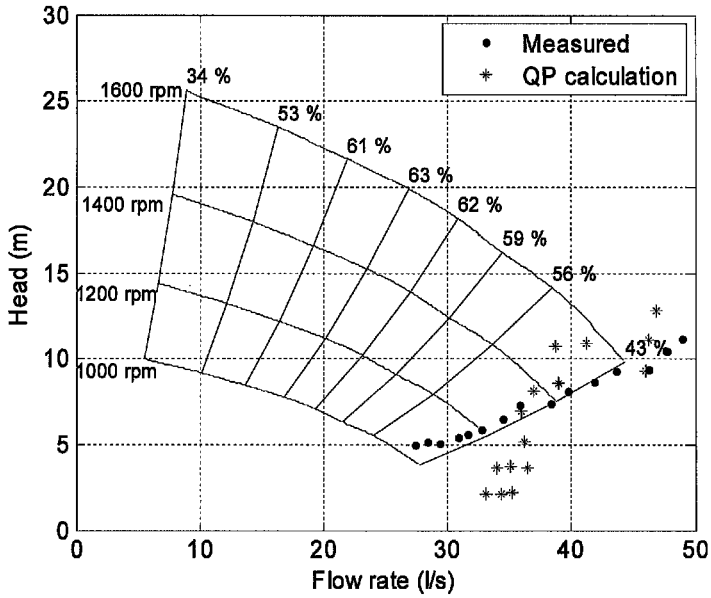
FIGS. 10 and 11 show measured and estimated values of operation points in accordance with an exemplary embodiment.

FIG. 10 is a graph illustrating measured and estimated values of operation in accordance with an exemplary embodiment. The estimation of the process curve was further tested using different volumetric flows. In particular, FIG. 10 shows measured and estimated operation points plotted against the QH curve of the pump. The volumetric flow of the pump was approximately 1.4*Qnom, which is outside the recommended operation range. As a result, it should be readily apparent that the QP calculation does not give satisfactory results. Namely, the calculated operation points (marked with '*') do not form a continuous line, but are somewhat randomly spread. The reason for the inaccurate results is the fact that the efficiency of the pump is decreased and the QP curve is thus flat, as explained in connection with FIG. 3.

Additionally, FIG. 10 shows that the process curve cannot be estimated from the obtained results. If the static head was known, the estimation of the process curve might, however, be also possible on the basis of these results.

Figure 11:
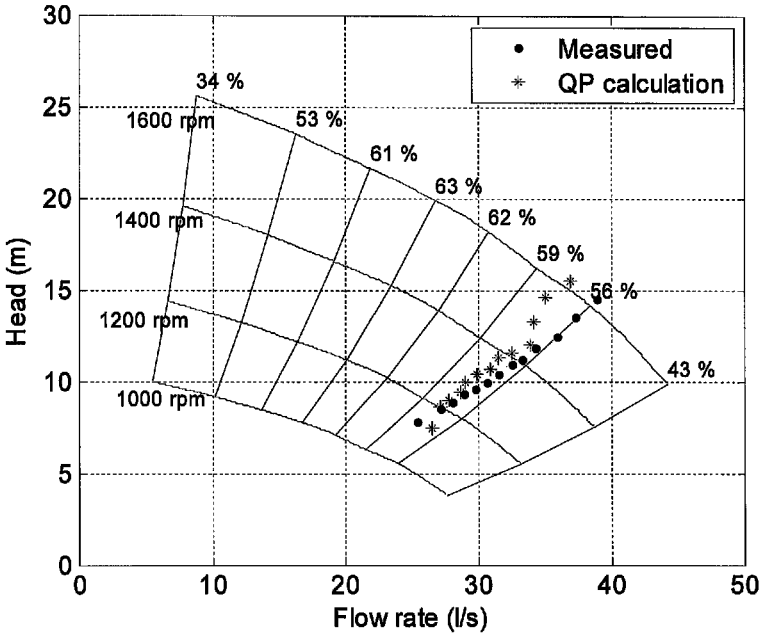

FIG. 11 is also a graph illustrating measured and estimated values of operation in accordance with an exemplary embodiment. The estimation of the process curve was also carried out with the volumetric flow of 1.2*Qnom. FIG. 11 shows the results from direct measurements ('•') and the QP calculation ('*') in the speed range of 1140 to 1620 rpm. It should be readily apparent that the QP calculation works best in the range of 1200 to 1450 rpm. At higher rotational speeds the weakening of the operation efficiency due to drifting of the operation point weakens the performance of the QP calculation.

Figure 12:
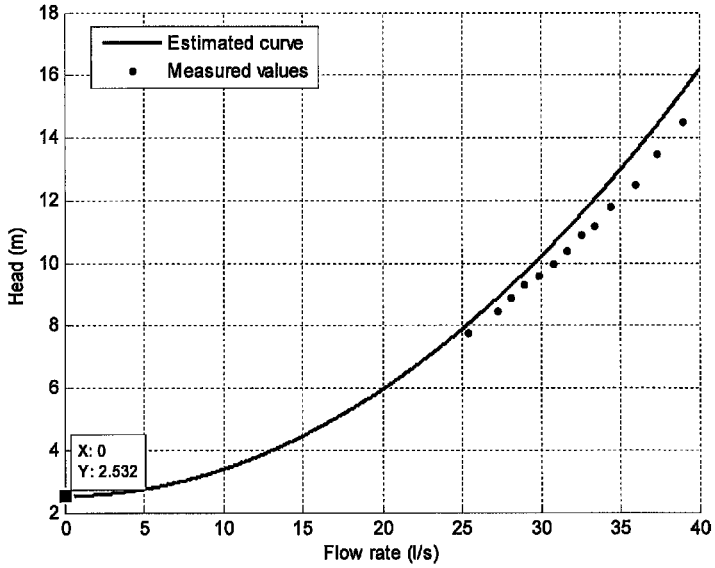
FIG. 12 shows an example of an estimated process curve in accordance with an exemplary embodiment.

FIG. 12 is a graph illustrating an example of an estimated process curve in accordance with an exemplary embodiment. In particular, FIG. 12 shows the process curve estimated from the calculated points in the speed range of 1200 to 1450 rpm together with the measured points. The shape of the process curve and the value of the static head are quite correct, but include some deviation from the measured values.

Figure 13:
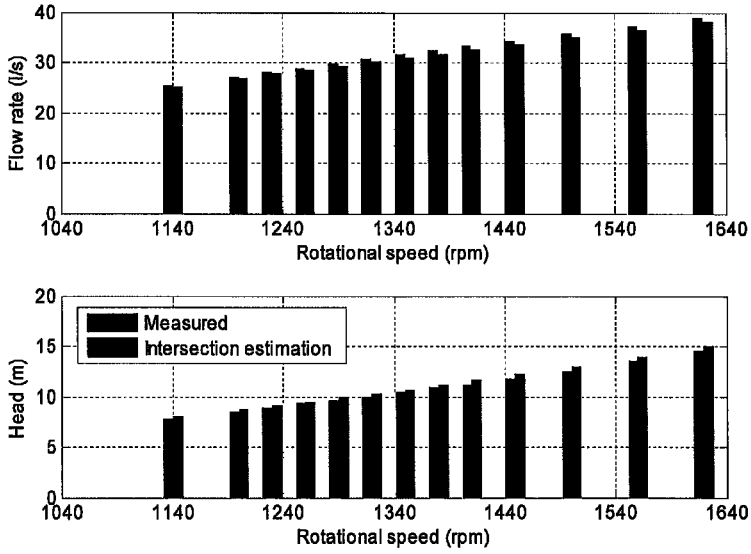
FIG. 13 shows test results of an estimation algorithm in accordance with an exemplary embodiment.
Figure 14:
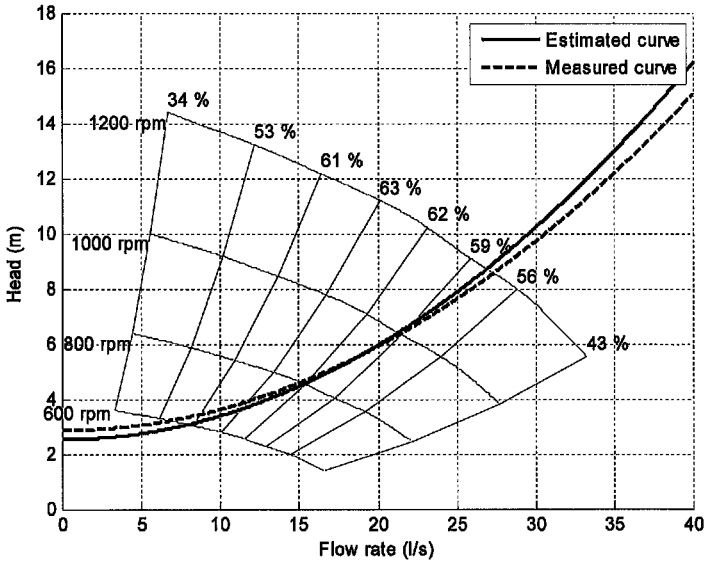
FIG. 14 shows process curves obtained with both measured operation points and estimated points in accordance with an exemplary embodiment.

FIG. 13 illustrates test results of an estimation algorithm in accordance with an exemplary embodiment. Particularly, FIG. 13 shows the analysis of the curves of FIG. 12 as bar diagrams. The upper bar diagram shows the volumetric flow at certain rotational speeds. The left bar at each rotational speed is the measured result and the right bar is the result obtained with an intersection point calculation. In the lower plot, results are given similarly for the head provided with the pump. It can be seen from the results that the errors in the estimated process curve do not have a great influence on the performance of the intersection point calculation. The measured and estimated points correspond to each other with an accuracy of 3% in the speed range of 1140 to 1620 rpm. If the pump is used with a speed not in the above range, the performance of the intersection point calculation becomes poorer. However, the results obtained with the intersection point calculation are likely to be more accurate than the ones obtained with the QP calculation even outside the above speed range. This can be determined for example from FIG. 14, in which the process curve (solid line) used in the intersection point calculation and the process curve (dashed line) obtained with direct measurement are plotted. These two curves intersect at a rotational speed of about 900 rpm. This further means that the intersection point calculation gives more reliable results from the operation of the pump than the QP calculation for example in the speed range of 800 to 1000 rpm.

Figure 15:
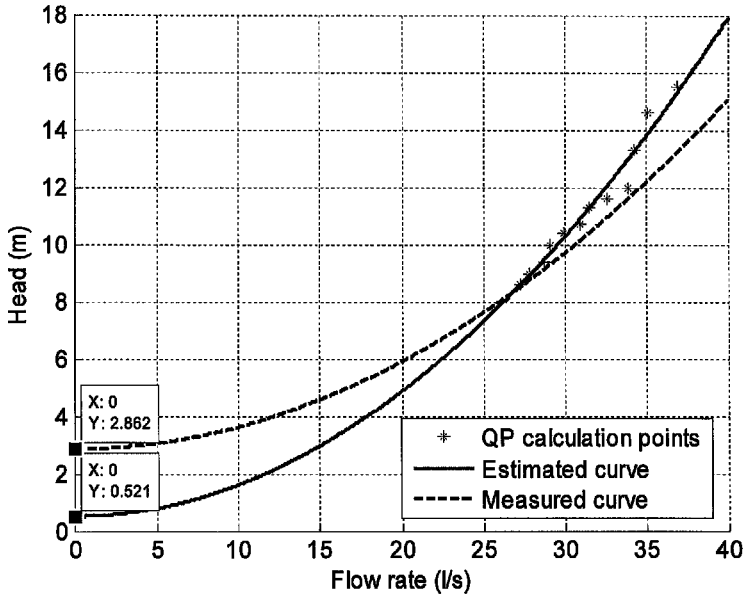
FIG. 15 shows the effect of erroneous values on the estimated process curve in accordance with an exemplary embodiment.
Figure 16:
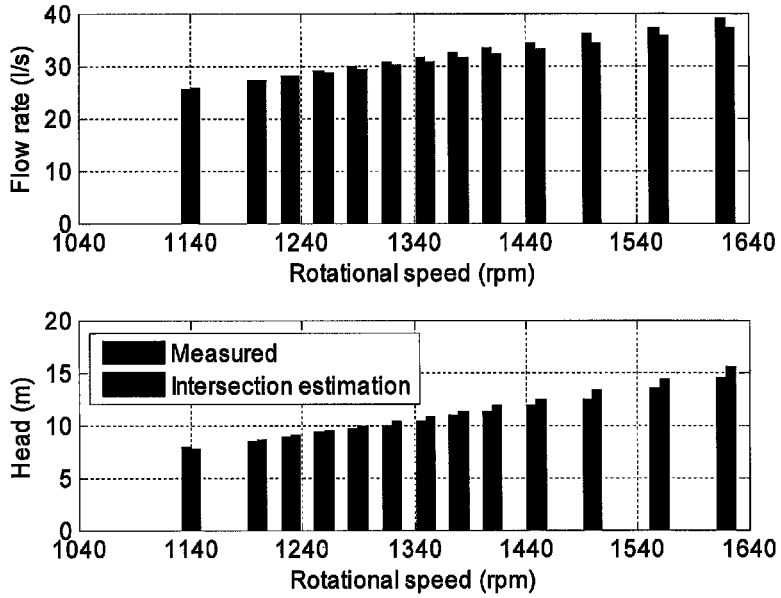
FIG. 16 shows comparative results of the estimation in accordance with an exemplary embodiment.

If, in the formation of a process curve, erroneous operation point estimates are also used (points from the QP calculation in the range 1500 to 1600 rpm, for example), the shape of the process curve can change considerably, as seen in FIG. 15. This makes the results of the intersection point calculation less accurate if the pump is used at very low speeds. FIG. 15 is a graph illustrating the effects of erroneous values on the estimated process curve in accordance with an exemplary embodiment. In FIG. 15, the values from the QP calculation are marked with '*', the estimated process curve with a solid line and measured process curve with a dashed line. When the speed is above 1140 rpm, there are no considerable errors in the intersection point estimation, as shown in FIG. 16. In FIG. 16, the measured and estimated values are presented like in FIG. 14.

For the estimation of the process curve, at least two operation points measured at different rotational speeds can be obtained. In practice this number should be higher, preferably three or more, for example five, in order to obtain reliable results. Further, the rotational speed range from which the operational points are gathered should be wide so that the shape of the estimated process curve would correspond to the actual curve.

When the process curve is estimated from three or more points, the influence of erroneous points from the estimated process curve is decreased due to averaging of the measured results.

The speed range from which the operational points are estimated using QP calculation should be as wide as possible. If the points are close to each other, the estimated process curve can have a shape that does not correspond to the actual shape of the curve. Thus, the rotational speed range from which the samples are gathered should be at least 125 rpm and preferably at least 150 rpm or even 250 rpm. If the rotational speed range is wider, the process curve will be more accurate.

It will be obvious to a person skilled in the art that, as the technology advances, the inventive concept can be implemented in various ways. The disclosure and its embodiments are not limited to the examples described above but may vary within the scope of the claims.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. A method of estimating an operation point of a pump driven with a frequency converter when a QH characteristic curve of the pump is known, wherein the method comprises:

controlling the pump with the frequency converter, wherein the controlling step comprises:

estimating a process curve when an operation point of the pump is in a nominal range, the process curve defining a head required by the process as a function of volumetric flow;

determining a rotational speed of the pump;

converting the QH characteristic curve of the pump to a current rotational speed of the pump;

(1) estimating the operation point of the pump with a QP calculation;

(2) estimating the operation point of the pump by determining the intersection point of the converted QH characteristic curve and the estimated process curve;

(3) calculating and storing a difference between corresponding operating points together with the rotational speed estimate;

repeating steps (1)-(3) and determining if the difference between the differently estimated operation points has changed; and estimating the process curve if the difference between the estimated operation points has changed.

2. The method of claim 1, wherein the estimation of the process curve comprises:

estimating using a QP calculation, a head ($h_{QP}$) produced with the pump and a volumetric flow ($Q_{QP}$) produced by the pump when the pump is operating in its nominal operation area, storing estimated values of the produced head and the volumetric flow together with the rotational speed of the pump, repeating for a predetermined number of times the steps of estimating the produced head and volumetric flow and storing the estimated values when the rotational speed of the pump changes, and forming a curve fitted to the estimated values, the curve representing the process curve.

3. The method of claim 1, wherein the rotational speed is determined by the frequency converter driving the pump.

4. The method of claim 1, wherein the operation is in the nominal range of 80% to 120% of a nominal volumetric flow of the pump and of a nominal rotational speed.

5. The method of claim 1, wherein the process curve is estimated when the pump is operated in the nominal range of 80% to 120% of the nominal volumetric flow of the pump and of the nominal rotational speed, and the operation point of the pump is estimated by determining the intersection point of the QH characteristic curve and a process curve when the operation point of the pump is outside the range of 80% to 120% of the nominal volumetric flow of the pump and of the nominal rotational speed.

6. The method of claim 2, wherein the rotational speed of the pump is determined by the frequency converter driving the pump.

7. The method of claim 2, wherein the operation is in the nominal range of 80% to 120% of a nominal volumetric flow of the pump and of a nominal rotational speed.

8. The method of claim 2, wherein the process curve is estimated when the pump is operated in the nominal range of 80% to 120% of the nominal volumetric flow of the pump and of the nominal rotational speed, and the operation point of the pump is estimated by determining the intersection point of the QH characteristic curve and a process curve when the operation point of the pump is outside the range of 80% to 120% of the nominal volumetric flow of the pump and of the nominal rotational speed.

9. The method of claim 3, wherein the operation is in the nominal range of 80% to 120% of a nominal volumetric flow of the pump and of a nominal rotational speed.

10. The method of claim 3, wherein the process curve is estimated when the pump is operated in the nominal range of 80% to 120% of the nominal volumetric flow of the pump and of the nominal rotational speed, and the operation point of the pump is estimated by determining the intersection point of the QH characteristic curve and a process curve when the operation point of the pump is outside the range of 80% to 120% of the nominal volumetric flow of the pump and of the nominal rotational speed.

11. The method of claim 4, wherein the process curve is estimated when the pump is operated in the nominal range of 80% to 120% of the nominal volumetric flow of the pump and of the nominal rotational speed, and the operation point of the pump is estimated by determining the intersection point of the QH characteristic curve and a process curve when the operation point of the pump is outside the range of 80% to 120% of the nominal volumetric flow of the pump and of the nominal rotational speed.

12. A frequency converter that estimates an operation point of a pump when a QH characteristic curve of the pump is known and the pump is adapted to be driven with the frequency converter, wherein the frequency converter comprises:

means for estimating a process curve when an operation point of the pump is in a nominal range, the process curve defining a head as a function of volumetric flow;

means for determining a rotational speed of the pump;

means for converting, based on affinity laws, the QH characteristic curve of the pump to a current present rotational speed of the pump;

wherein the frequency converter:

(1) estimates the operation point of the pump with a QP calculation, (2) estimates the operation point of the pump by determining the intersection point of the converted QH characteristic curve and the estimated process curve, (3) calculates and storing a difference between corresponding operating points together with the rotational speed estimate, repeats steps (1)-(3) and determines if the difference between the differently estimated operation points has changed, and estimates the process curve if the difference between the estimated operation points has changed.

* * * * *